US008146304B1

(12) United States Patent
Plummer et al.

(10) Patent No.: US 8,146,304 B1
(45) Date of Patent: Apr. 3, 2012

(54) GRILLE ASSEMBLY FOR DOORS AND METHOD FOR MAKING

(75) Inventors: John B. Plummer, Houston, TX (US); Marjorie Plummer, Spring, TX (US); Joseph Gene Denley, Cypress, TX (US)

(73) Assignee: Glasscraft Door Company, Houston, TX (US)

( * ) Notice: Subject to any disclaimer, the term of this patent is extended or adjusted under 35 U.S.C. 154(b) by 119 days.

(21) Appl. No.: 12/842,941

(22) Filed: Jul. 23, 2010

(51) Int. Cl.
*E06B 3/964* (2006.01)

(52) U.S. Cl. ..... 52/204.61; 52/204.66; 52/208; 52/745.15; 49/63; 49/67; 16/382

(58) Field of Classification Search ..... 52/204.61, 52/204.62, 204.66, 204.67, 205, 208, 456, 52/745.15; 16/86.1, 252, 253, 382; 49/50, 49/54, 56, 61–63, 65, 67
See application file for complete search history.

(56) References Cited

U.S. PATENT DOCUMENTS

| | | | | | |
|---|---|---|---|---|---|
| 2,050,322 | A | * | 8/1936 | Hills | 49/57 |
| 2,093,727 | A | * | 9/1937 | Julien | 49/62 |
| 2,537,896 | A | * | 1/1951 | Hinton et al. | 292/1 |
| 3,183,547 | A | * | 5/1965 | Bury | 16/238 |
| 3,308,593 | A | | 3/1967 | Smith | |
| 3,760,543 | A | * | 9/1973 | McAllister | 52/204.591 |
| 3,791,095 | A | | 2/1974 | Martin | |
| 3,871,434 | A | * | 3/1975 | Hance | 160/91 |
| 3,895,669 | A | * | 7/1975 | Heeling | 160/92 |
| 3,946,531 | A | | 3/1976 | Armstrong | |
| 4,204,015 | A | | 5/1980 | Wardlaw et al. | |
| 4,567,710 | A | | 2/1986 | Reed | |
| 4,652,472 | A | | 3/1987 | Davies | |
| 4,783,938 | A | | 11/1988 | Palmer | |
| 4,989,381 | A | * | 2/1991 | De Block et al. | 52/204.51 |
| 4,989,384 | A | | 2/1991 | Kinghorn et al. | |
| 5,018,330 | A | * | 5/1991 | Lewkowitz | 52/455 |
| 5,092,101 | A | | 3/1992 | Kunert | |
| 5,267,421 | A | | 12/1993 | Salisbury | |
| 5,345,743 | A | | 9/1994 | Baier | |
| 5,436,040 | A | | 7/1995 | Lafond | |
| 5,477,647 | A | | 12/1995 | Yates, Jr. | |
| 5,644,881 | A | * | 7/1997 | Neilly | 52/455 |
| 5,653,057 | A | * | 8/1997 | Gary | 49/67 |

(Continued)

FOREIGN PATENT DOCUMENTS

GB 2276651 A * 10/1994

*Primary Examiner* — Brian Glessner
*Assistant Examiner* — Adriana Figueroa
(74) *Attorney, Agent, or Firm* — Buskop Law Group, PC; Wendy Buskop

(57) ABSTRACT

An external grille assembly for a door. The external grille assembly can include a door insert. The insert can have a translucent panel, an exterior frame with screw bosses, an interior frame with screw bosses attached to the exterior frame, a connector hole formed in one of the screw bosses, and a connector engaged within the connector hole. The connector can provide attachment between the insert and an external grille. The external grille can be removably and pivotably mounted to the insert and connector with a pin. The connector can include a first plate connected to a second plate, a first tubular disposed within the connector hole, a fastener engaging the first tubular within the connector hole and attaching the connector to the insert, and a second tubular for receiving the pin. Also disclosed is a method a making the external grille assembly.

19 Claims, 9 Drawing Sheets

U.S. PATENT DOCUMENTS 5,834,124 A * 11/1998 Pease et al. ..... 428/430
5,981,631 A 11/1999 Ronden et al.
6,115,989 A 9/2000 Boone et al.
6,192,651 B1 2/2001 Donaldson
6,272,801 B1 * 8/2001 Suh ..... 52/211
6,345,485 B1 2/2002 Boone et al.
6,671,572 B1 12/2003 Craft et al.
7,681,369 B2 3/2010 Soltesiz et al.
7,743,570 B2 6/2010 Reichert
7,949,422 B1 5/2011 Little et al.
2004/0035056 A1 * 2/2004 Briscoe et al. ..... 49/67
2007/0154663 A1 7/2007 Wang et al.
2008/0006760 A1 1/2008 Sibbett
2008/0047208 A1 2/2008 Soltesiz et al.
2009/0090062 A1 * 4/2009 Pandorf ..... 49/50
2009/0139165 A1 6/2009 Prete et al.
2010/0236167 A1 9/2010 Parker

* cited by examiner

GRILLE ASSEMBLY FOR DOORS AND METHOD FOR MAKING

FIELD

The present embodiments generally relate to an assembly including an external grille connected to a door with a connector, and a method of making the same.

BACKGROUND

A need exists for a door with a removable external grille attached thereto in a pivotable manner.

A further need exists for an external grille that can be attached to a preexisting door insert using a connector adapted to engage the preexisting door insert.

The present embodiments meet these needs.

BRIEF DESCRIPTION OF THE DRAWINGS

The detailed description will be better understood in conjunction with the accompanying drawings as follows.

Figure 3:
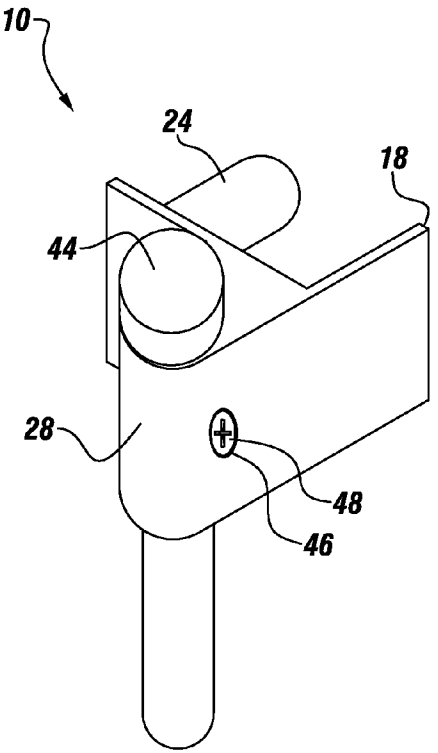
FIG. 3 depicts a profile view of an embodiment of the connector.

The present embodiments are detailed below with reference to the listed Figures.

DETAILED DESCRIPTION OF THE EMBODIMENTS

Before explaining the present apparatus and method in detail, it is to be understood that the apparatus and method are not limited to the particular embodiments and that the apparatus and method can be practiced or carried out in various ways.

The present embodiments relate to a light assembly including a door insert, an external grille, and a connector for connecting the external grille to the door insert. The connector can be used to connect a grille onto an external surface of a door insert. The door insert can be installed into a door.

One or more embodiments have the unique benefit of being adapted such that the external grille can be installed directly onto an industry standard door insert, rather than attaching the external grille directly to the door, such as to the surface of the door, as is commonly done in the art.

The door insert can be an industry standard door insert, and can be inserted into a door, such as into an opening within a door. The door can be a fiberglass door, a wooden door, a steel door, or another door. The door insert can provide a decorative feature to the door. The door insert can be a framed translucent panel that can be installed into an opening of a door. The door insert frame can be engaged over a first side and a second side of the translucent panel. The translucent panels of the door insert can be tempered safety glass panels that can be disposed or mounted into the door insert frame. The door insert can be made of aluminum, another metal, plastic, wood, a composite compound, or combinations thereof.

The door insert can include a translucent panel with a first side and a second side. The translucent panel can be a glass panel, a Plexiglas® panel, a textured glass panel, an insulated glass panel, a tempered safety glass panel, an approved and certified safety material panel, a privacy window, another transparent and/or translucent panel or combinations thereof.

The door insert can include a frame. The frame can include an exterior frame with a plurality of screw bosses and an exterior frame opening. The exterior frame can include from six to twenty screw bosses. The exterior frame can be disposed over the first side of the translucent panel, and the translucent panel can be disposed within or behind the exterior frame opening. The exterior frame can be made of metal, wood, plastic, a polymeric material, fiberglass, or another material. The screw bosses on the exterior frame are also herein referred to as exterior screw bosses.

The frame of the door insert can include an interior frame with a plurality of screw bosses and an interior frame opening. The interior frame can include from six to twenty screw bosses. The interior frame can be disposed over the second side of the translucent panel, and the translucent panel can be disposed within or in front of the interior frame opening. The screw bosses on the interior frame are also herein referred to as interior screw bosses.

The plurality of exterior screw bosses can be axially aligned with the plurality of interior screw bosses. Each exterior screw boss can be formed as a tubular extension extending from the exterior frame, and each interior screw boss can be formed as a tubular extension extending from the interior frame. Each screw boss can be tapered. Each screw boss can have a through hole or a conduit formed therein for receiving a fastener. For example, a fastener can engage through one of the plurality of interior screw bosses, through one of the plurality of exterior screw bosses, and can be fastened to the exterior screw boss, thereby attaching the interior frame to the exterior frame. The fastener can be threadably attached to the exterior screw boss. A fastener can be simultaneously disposed through each exterior screw boss and each interior screw bosses. One or more embodiments can include an exterior frame and an interior frame connected without screw bosses, but by another connecting or fastening means or method, such as a snapping engagement.

The assembly can include at least one connector hole or conduit. The connector hole can be formed on a first side of the frame, and can be a hole at least partially disposed through the frame of the door insert. An exterior connector hole can be formed on a first side of the exterior frame and can be axially aligned with one of the plurality of interior screw bosses. An interior connector hole can be formed on a first side of the interior frame and can be axially aligned with one of the plurality of exterior screw bosses or with the exterior connector hole. In one or more embodiments, the connector hole can be formed within one of the screw bosses. For example, the connector hole can be an external screw boss or an internal screw boss that has been configured or adapted to receive a connector, such as by drilling within the screw boss. The connector hole can have a stop formed therein. The stop can be a portion of the connector hole that has a diameter smaller than the rest of the connector hole, and a diameter larger than a first tubular of the connector. The first tubular can be inserted into the connector hole and can engage the stop within connector hole. In one or more embodiments, an external screw boss or an internal screw boss can be drilled-out using a drill to enlarge the screw boss such that the connector can be engaged therein.

The connector of the assembly can be engaged within the connector hole, such as within the exterior connector hole. The connector can be formed of steel, plastic, a reinforced plastic, a polymeric material, a metal, or another material. The connector can include a coating disposed on a surface of the connector.

In one or more embodiments, the connector can be engaged within an exterior connector hole and attached thereto. For example, the connector can be engaged within the exterior connector hole and a fastener can be engaged with the connector opposite the exterior frame, thereby attaching the connector to the exterior frame. The fastener can be disposed between the exterior frame and the interior frame.

In one or more embodiments, the connector can be engaged within the one or both of the exterior connector hole and the interior connector hole, and attached thereto. For example, the connector can be engaged within the exterior connector hole, and a fastener can be engaged through the interior connector hole and with the connector, thereby attaching the connector to the frame.

The connector can include a first plate or first flange. The first plate or first flange can be connected to a second plate or second flange at an angle, such as a right angle. Each plate can have a first side, a second side, a first edge, a second edge, a top edge, and a bottom edge. Each plate can have a width from about one half inch to about one and one-fourth inches and a height from about three-eighths of an inch to about two inches.

The connector can include a first tubular extending from the first side of the first plate at an angle, such as a right angle. The first tubular can extend parallel to the second plate. The first tubular can be disposed within the connector hole, thereby attaching the connector to the frame. The first tubular can have an inner diameter from about one-fifth of an inch to about three-twentieths of an inch.

The first tubular can be generally cylindrical and can include a hole, which can be a cylindrical hole, fastener hole, or conduit concentrically disposed within the first tubular. In one or more embodiments, the hole of the first tubular can extend through the first plate. The hole can be a fastener hole that can be adapted to receive a fastener for securing the connector to the frame and thereby to the door insert. For example, the fastener hole can be threaded. When the first tubular is inserted into the connector hole, the fastener hole can be axially aligned with an interior screw boss that is axially aligned with the connector hole. A fastener can be inserted through the interior screw boss and threadably fastened into the fastener hole of the first tubular; thereby attaching the connector to the door insert.

In one or more embodiments, the first tubular can be disposed centrally between the top edge of the first plate and the bottom edge of the first plate. The first tubular can be offset from the first edge of the first plate. For example, the first tubular can be disposed closer to the second edge of the first plate than to the first edge of the first plate. The first tubular can be configured to engage within a connector hole within a frame of a door insert. The first tubular can be inserted into the connector hole such that the first tubular is fittingly engaged with the connector hole. When the first tubular is inserted into the connector hole, an exterior surface of the first tubular can fit flush against an interior surface of the connector hole.

A space can be formed on the first side of the first plate between the first tubular and the second plate. The space can be configured to receive a frame of a door insert. For example, when the first tubular is inserted into the connector hole, the space can be of a size such that a portion of the frame of the door insert fits within the space. With the first tubular inserted into the connector hole, the portion of the frame can fittingly engage within the space, can engage the first side of the first plate, and can engage the second side of the second plate. For example, with the first tubular inserted into the connector hole, the portion of the frame can fit flush against the first side of the first plate and can fit flush against the second side of the second plate.

The connector can include a second tubular that can be disposed at or proximate an intersection of the first plate and the second plate. The second tubular can extend from the second side of the first plate at an angle, such as a right angle, and can have a curved exterior surface. The second tubular can be integrally formed with the first plate or connected thereto. The second tubular can be generally cylindrical and can include a hole, which can be a cylindrical hole, a fastener hole, a through hole, or a conduit concentrically disposed within the second tubular. The hole of the second tubular can extend perpendicular to the hole of the first tubular. The hole of the second tubular can have an inner diameter from about one-eighth of an inch to about one-half of an inch. The hole of the second tubular can be a fastener hole, such as a threaded hole, that can be adapted to receive a fastener for securing the connector to a grille; thereby attaching the grille to the door insert. The hole of the second tubular can be a smooth surfaced hole that can be adapted to receive a pin, a bolt, or a fastener for securing the connector to a grille; thereby attaching the grille to the door insert. The smooth surface can be configured to allow the pin, the bolt, or the fastener to rotate within the hole.

One or more embodiments can include a tapped hole that can be disposed through the second tubular. The tapped hole can be a threaded hole. A fastener, such as a set screw, can be disposed through the tapped hole and can be engaged with the pin inside the second tubular; thereby securing the pin within the second tubular. In operation, when a pin is inserted into the second tubular, the fastener, or set screw, can engage through the tapped hole to secure to the pin, thereby providing a locking engagement between the pin and the second tubular.

In one or more embodiments, the first tubular, the second tubular, the first plate, and the second plate can be a single piece integral structure.

The external grille, also referred to as a grille, can be attached to the door insert such that the grille can be opened in a pivotable manner; thereby providing access to the door insert disposed behind the grille for cleaning and other purposes. In one or more embodiments, the grille can be permanently secured to the door insert.

The grille can be made of wrought iron, a polymeric material, a plastic, a metal, a wood, a composite, a fiberglass, a high-density polypropylene, or another material. The grille can be rigid and strong to provide for safety and security. The grille can also add a decorative and sophisticated appearance to the door insert.

The grille can have a grille frame that can have a rectangular shape, a square shape, a circular shape, or another shape. The grille frame can have a perimeter that can include a grille top, a grille first side, a grille bottom, and a grille second side. The grille top, grille first side, grille bottom, and grille second side can each be individual pieces that are connected together to form a portion of the grille frame. An opening can be formed between the grille top, the grille sides, and the grille bottom. The grille frame can include square tubulars, round tubulars, L-shaped angled bars, or combinations thereof. The grille can have a grille design portion that can be disposed within the opening of the grille frame. The grille design portion can be a decorative grille and can include various shapes, designs, openings, linear portions, and curvilinear portions. The grille design portion can be disposed over and can cover from about five percent to about ninety percent of the transparent panel.

At least one mount barrel can be attached to, formed on, welded to or otherwise disposed on the grille first side and/or the grille second side. The mount barrel can be formed as a generally cylindrical member having a hollow, a through hole, or a conduit. The through hole of the mount barrel can be adapted to receive a fastener, such as a pin or a bolt.

With the connector attached to the door insert, the grille can attached to the connector; thereby attaching the grille to the door. For example, the grille can be disposed or positioned such that the through hole of the mount barrel is concentrically and/or axially aligned with the second tubular of the connector. A pin, a bolt, or another fastener can be simultaneously engaged through the mount barrel and through the second tubular, thereby mounting the grille to the connector and to the door insert. The pin can include a pin body connected to a pin head. The pin can be made of steel, aluminum, plastic, a composite, a powder coated material, or combinations thereof. The pin body can be threaded or smooth surfaced, and can have a diameter of about three-tenths of an inch and a length of two inches. The pin head can have a diameter of about one-half of an inch.

The grille, when mounted to the connector and to the door insert, can be pivotable about the pin, such that a user can open the grille away from the door to provide access to the door, the door insert, or the translucent panel.

One or more embodiments can include multiple connectors, such as from about four connectors to about six connectors, connected to each side of the door insert, allowing for multiple points of attachment of the grille to one or both sides of the door. The grille can include one or more mount barrels on the grille first side and the grille second side, allowing for multiple points of attachment of the grille to one or both sides of the door. Each mount barrel can be engaged with a connector. The mount barrels disposed on the grille first side can all be axially and/or concentrically aligned with each other and disposed in a spaced apart relationship. The mount barrels disposed on the grille second side can all be axially and/or concentrically aligned with each other and disposed in a spaced apart relationship.

In one or more embodiments, the grille can include two mount barrels on each side, and a connector can engage each mount barrel for attaching the grille to the door. The grille, when mounted to at least one connector on the grille first side and to at least one connector on the grille second side, can be securely engaged with the door insert. In operation, for example, each pin attaching the grille first side to the door insert can be removed, allowing the grille to be pivoted about each pin attaching the grille second side to the door insert. Each connector of the assembly can be disposed within a connector hole that can be formed in substantially the same manner as described above. By removing each pin on one side of the grille and allowing the grille to pivot about the pins on the other side of the grille, a user can access the door, such as for cleaning, maintenance, or repair of the door.

The pin can be removable from the mount barrel and the second tubular of the connector. The grille can be removable from the connectors, allowing for attachment of an impact-resistant material to the connectors, and thereby to the door insert. The impact-resistant material can have a mount barrel as described above for attaching the impact-resistant material to the connectors. The impact-resistant material can be adapted to withstand forces from storms, hurricanes, tornadoes, tsunamis, and other hazards. The impact-resistant material can be plywood, plastic plates, metal slats, metal sheets, a composite material, a hurricane impact-resistant fabric mounted on a rigid frame, or another material.

Figure 1:
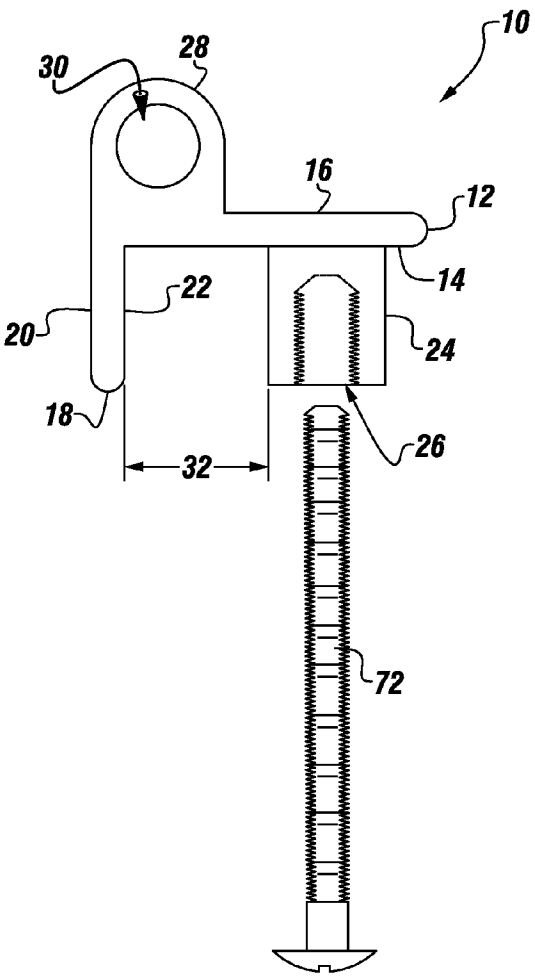
FIG. 1 depicts a top view of an embodiment of a connector.

Turning now to the Figures, FIG. 1 depicts a top view of an embodiment of a connector 10. The connector 10 can have a first plate 12 with a first plate first side 14 and a first plate second side 16.

The connector 10 can have a second plate 18 connected to the first plate 12. The second plate can have a second plate first side 20 and a second plate second side 22.

The connector 10 can have a first tubular 24 extending from the first plate 12. The first tubular 24 can have a fastener hole 26. A fastener 72 can engage within the fastener hole 26.

The connector can have a second tubular 28 disposed proximate an intersection of the first plate 12 and the second plate 18. The second tubular 28 can have a through hole 30 extending at a right angle to the fastener hole 26.

A space 32 can be formed on the first plate first side 14 between the first tubular 24 and the second plate 18.

Figure 2:
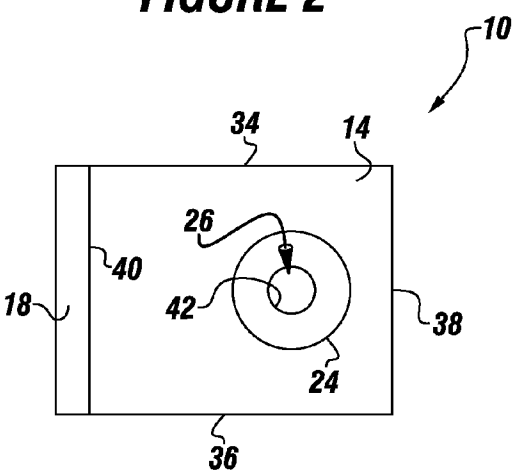
FIG. 2 depicts a side view of an embodiment of the connector.

FIG. 2 depicts a side view of the connector 10 with the first tubular 24 centered on the first plate first side 14 between a first plate top edge 34 and a first plate bottom edge 36. The first tubular 24 can be disposed closer to a first plate first side edge 38 than to a first plate second side edge 40. The first tubular 24 can have a smooth surface 42 within the fastener hole 26. Also depicted is the second plate 18.

FIG. 3 depicts a profile view of an embodiment of the connector 10 with a pin 44 disposed within the second tubular 28. The second tubular 28 can have a threaded hole 46 disposed therethrough. A set screw 48 can be disposed within the threaded hole 46. Also depicted is the first tubular 24 and the second plate 18.

Figure 4:
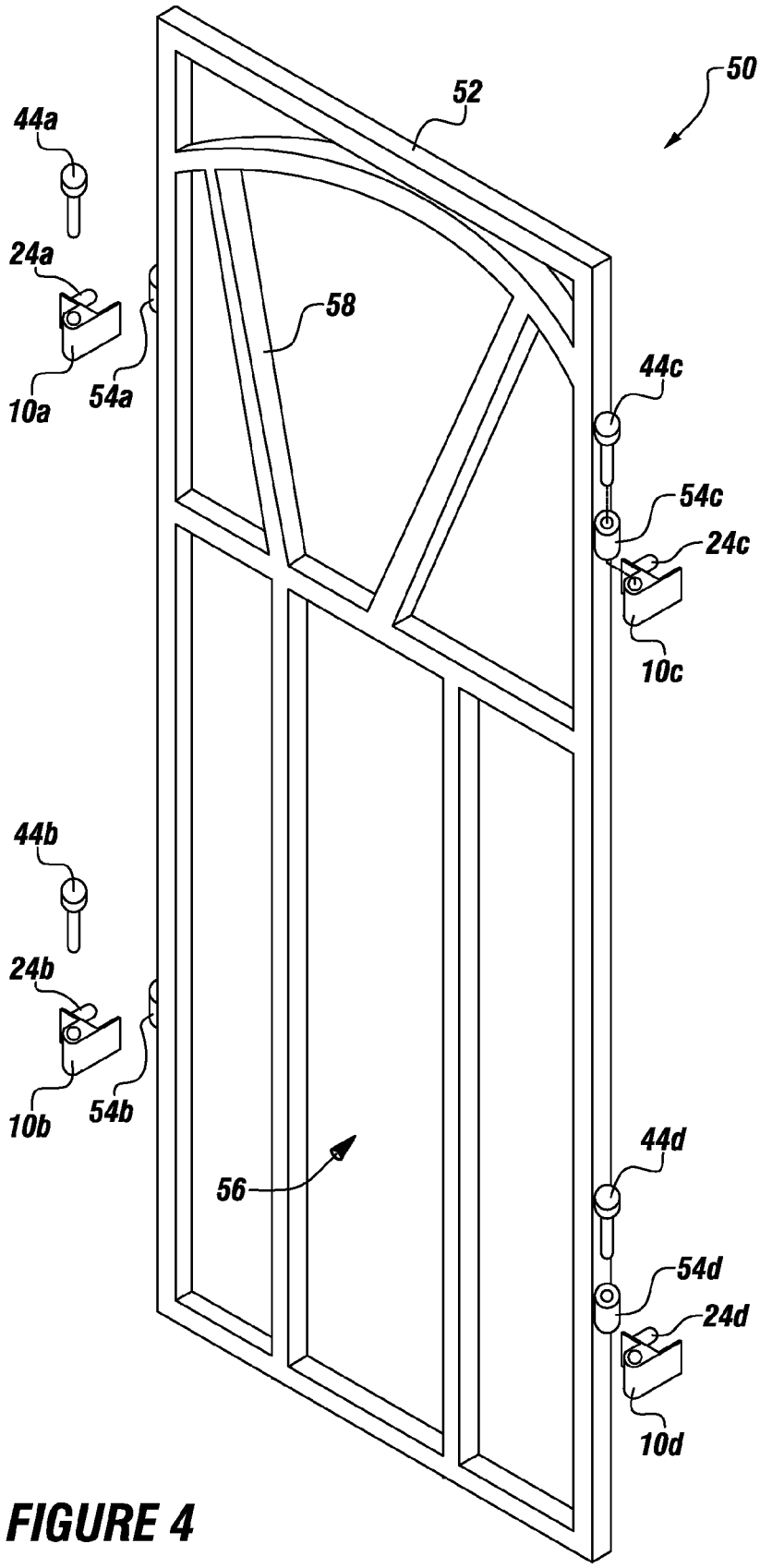
FIG. 4 depicts an exploded view of an embodiment of an external grille, connectors, and pins.

FIG. 4 depicts an exploded view of an embodiment of an external grille 50, which can be attached to one or more connectors, including connector 10*a*, connector 10*b*, connector 10*c*, and connector 10*d*. The external grille 50 can have a grille frame 52 with one or more mount barrels connected or disposed thereon, including mount barrel 54*a*, mount barrel 54*b*, mount barrel 54*c*, and mount barrel 54*d*. A pin can simultaneously engage one of the mount barrels and one of the connectors. Pin 44*a*, pin 44*b*, pin 44*c*, and pin 44*d* are depicted. The grille frame 52 can have an opening 56. Also depicted is an insert tubular 24*a*, an insert tubular 24*b*, an insert tubular 24*c*, and an insert tubular 24*d*.

Figure 5:
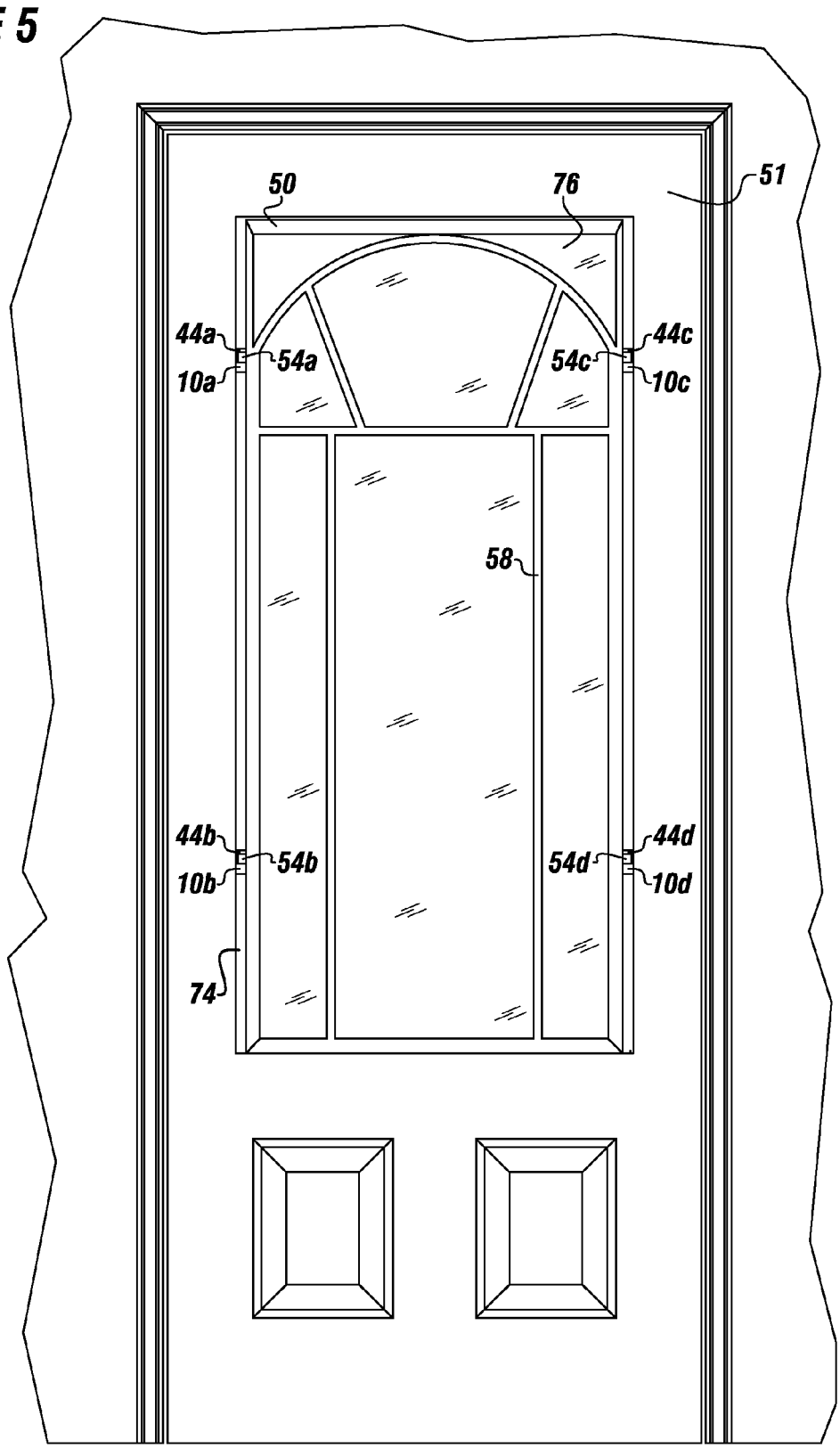
FIG. 5 depicts an embodiment of an external grille with connectors attached to a door.

FIG. 5 depicts an exploded view of an embodiment of an external grille 50 connected to a door 51. The external grille 50 is attached to a door insert 74 with connector 10*a*, connector 10*b*, connector 10*c*, and connector 10*d*. The door insert 74 is attached to the door 51. The door insert 74 can include a translucent panel 76.

A pin 44*a* can be simultaneously engaged with a mount barrel 54*a* of the external grille 50 and the connector 10*a*. A pin 44*b* can be simultaneously engaged with a mount barrel 54*b* of the external grille 50 and the connector 10*b*. A pin 44*c* can be simultaneously engaged with a mount barrel 54*c* of the external grille 50 and the connector 10*c*. A pin 44*d* can be simultaneously engaged with a mount barrel 54*d* of the external grille 50 and the connector 10*d*. The external grille 50 can include a grille design portion 58.

Figure 6:
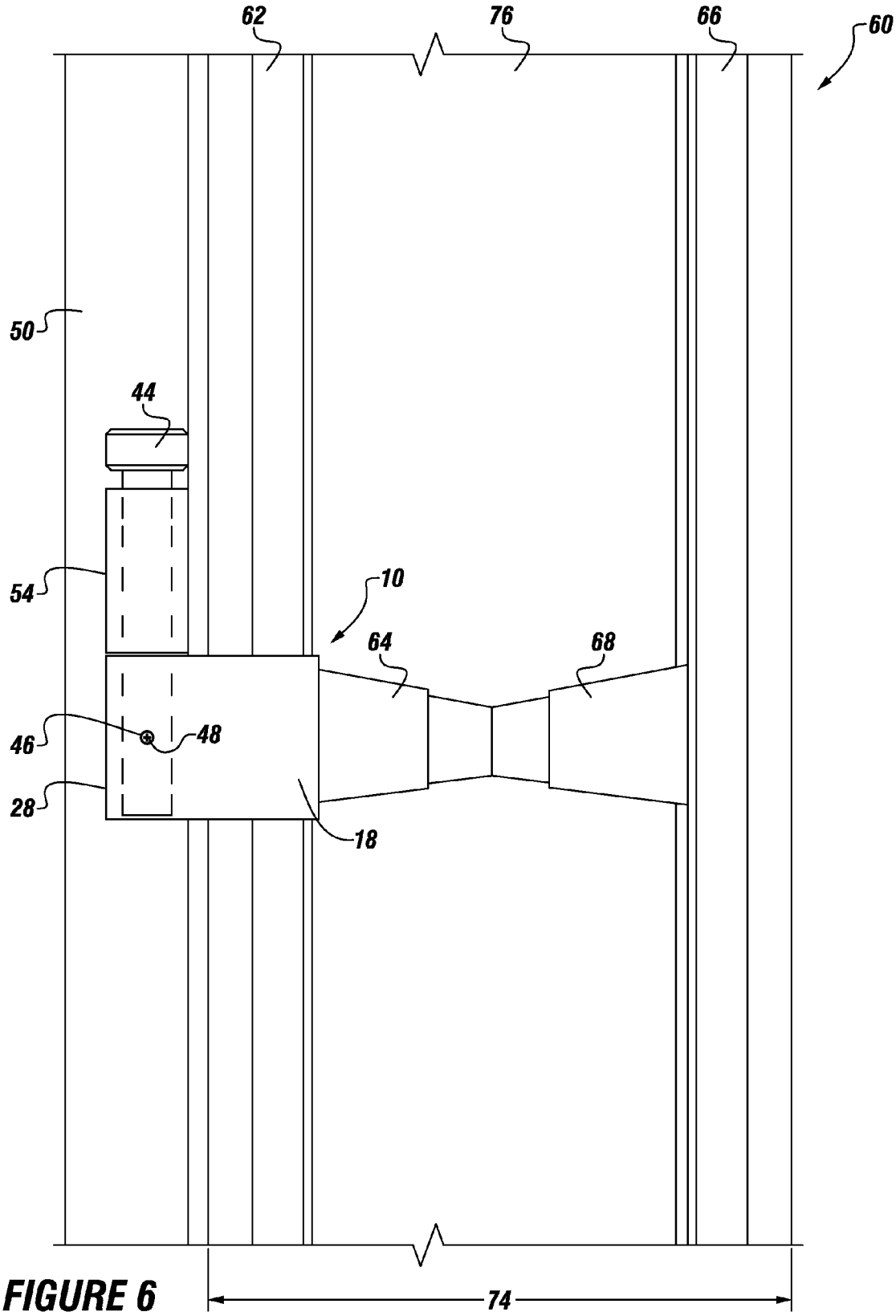
FIG. 6 depicts a cut view of an external grille assembly.

FIG. 6 depicts an assembled view of an embodiment of an external grille assembly 60. The external grille assembly 60 can include a door insert 74. The door insert 74 can include an exterior frame 62 with an exterior screw boss 64, an interior frame 66 with an interior screw boss 68, and a translucent panel 76 disposed there-between.

A pin 44 can engage through a mount barrel 54 of an external grille 50, and through the second tubular 28 of the connector 10; thereby attaching the external grille to the connector and to the exterior frame 62. Also depicted is a tapped hole 46, a set screw 48 and the second plate 18.

Figure 7:
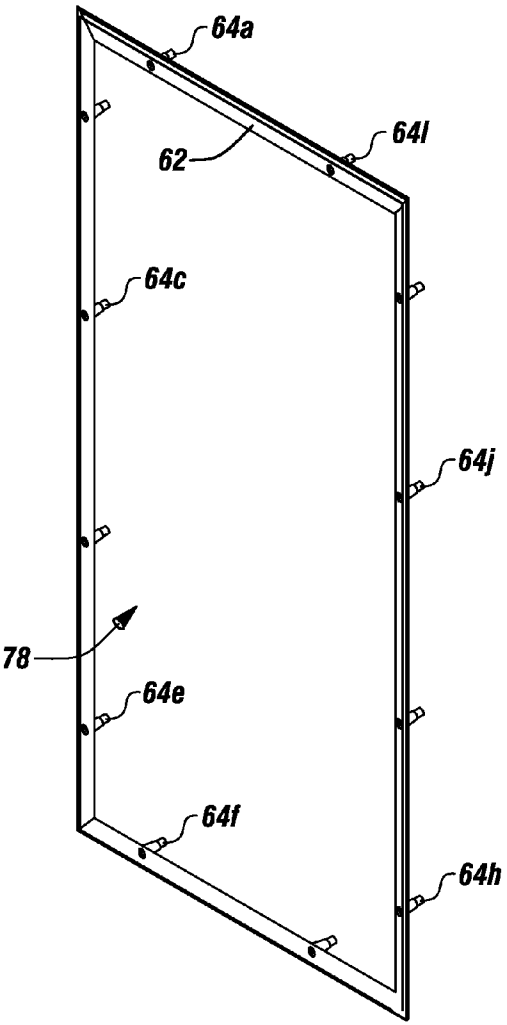
FIG. 7 depicts an embodiment of an external frame of a door insert.

FIG. 7 depicts a view of an exterior frame 62 including: an exterior frame opening 78 and a plurality of exterior screw bosses 64*a*, 64*c*, 64*e*, 64*f*, 64*h*, 64*j* and 64*l*.

Figure 8:
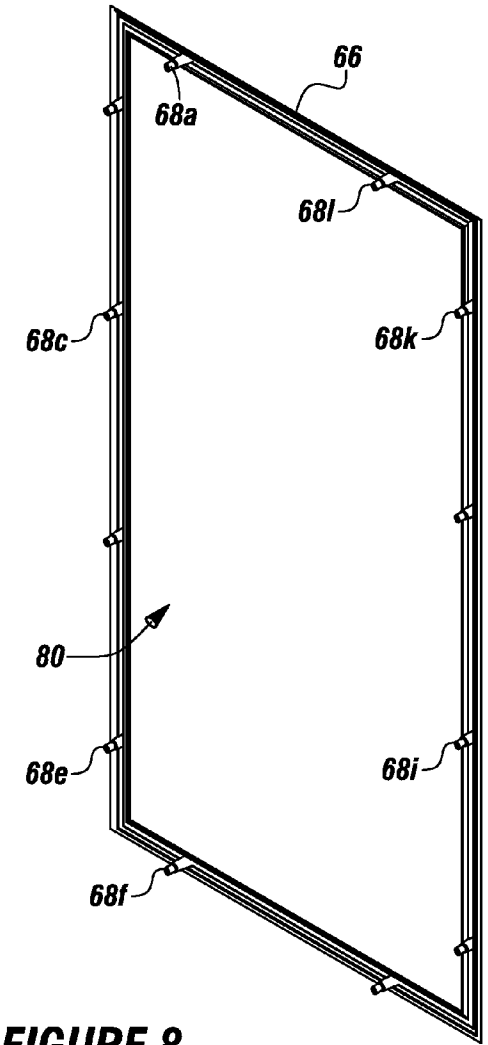
FIG. 8 depicts an embodiment of an internal frame of a door insert.

FIG. 8 depicts a view of an interior frame 66 including: an interior frame opening 80 and a plurality of interior screw bosses 68*a*, 68*c*, 68*e*, 68*f*, 68*i*, 68*k* and 68*l*.

Figure 9:
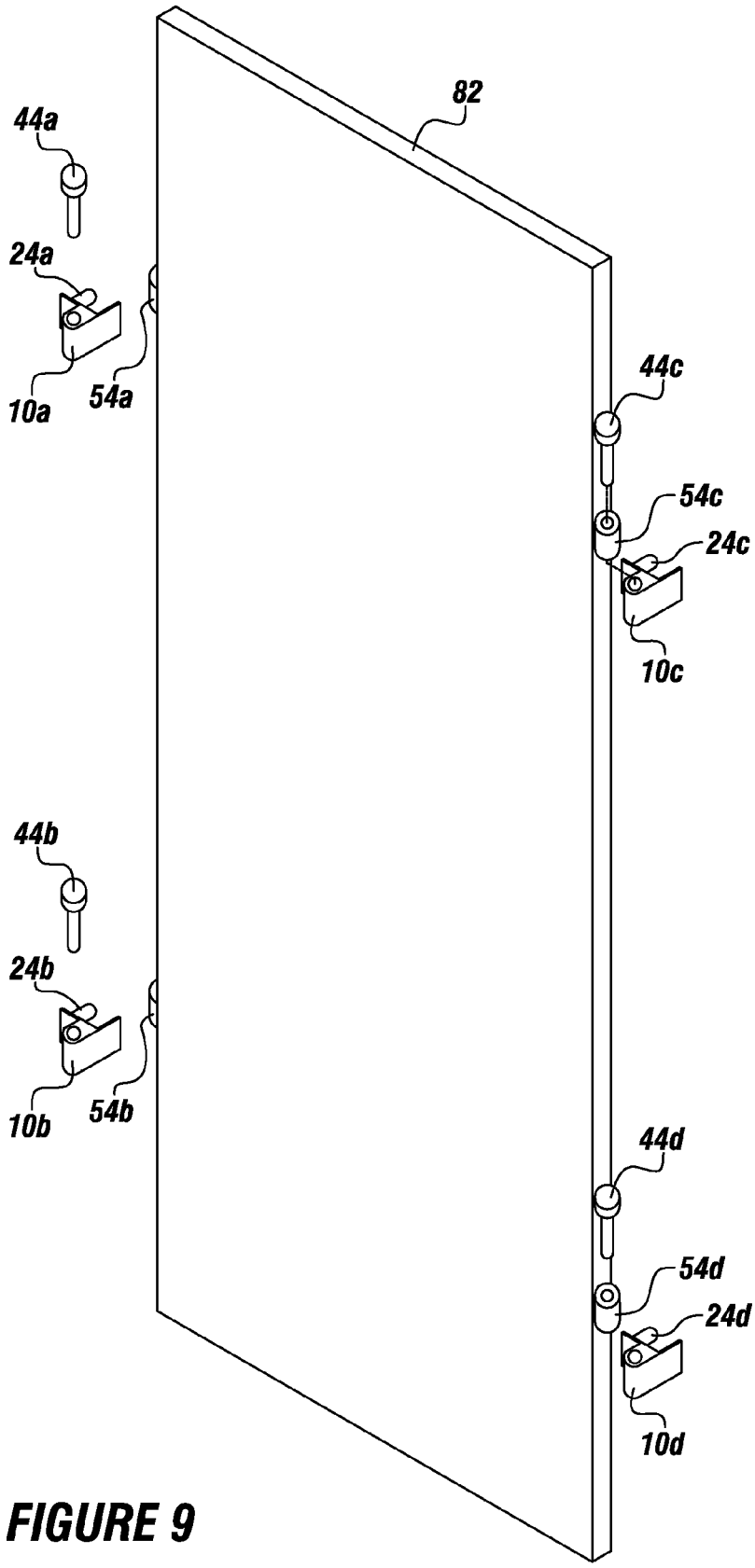
FIG. 9 depicts an exploded view of an embodiment of an impact-resistant material, connectors, and pins.

FIG. 9 depicts an embodiment of an impact-resistant material 82 that can be attached to a door insert using the connectors, including connector 10*a*, connector 10*b*, connector 10*c*, and connector 10*d*.

The impact-resistant material 82 can have one or more mount barrels connected or disposed thereon, including mount barrel 54*a*, mount barrel 54*b*, mount barrel 54*c*, and mount barrel 54*d*. A pin can simultaneously engage one of the mount barrels and one of the connectors. Pin 44*a*, pin 44*b*, pin 44*c*, and pin 44*d* are depicted. Also depicted is first tubular 24*a*, first tubular 24*b*, first tubular 24*c*, and first tubular 24*d*.

Figure 10:
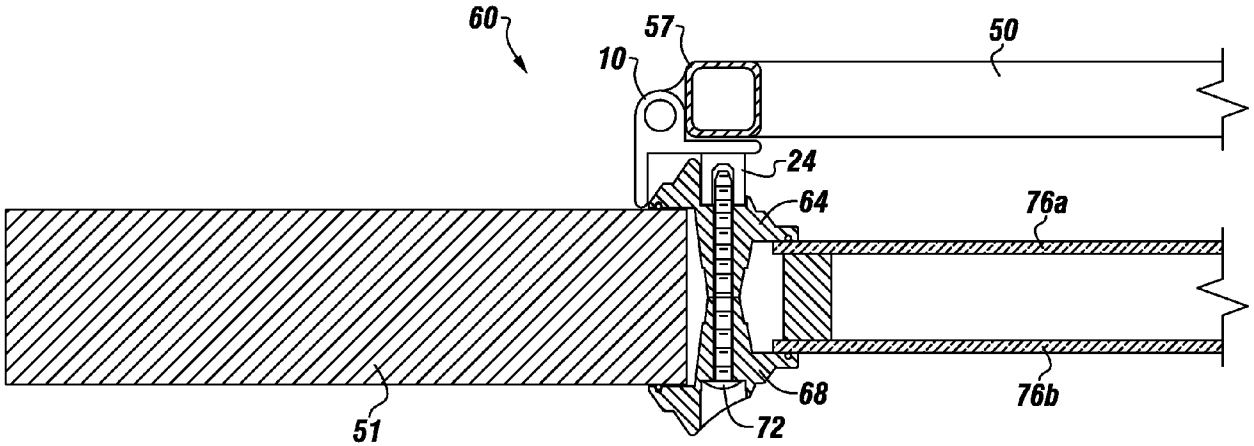
FIG. 10 depicts a top cut view of an embodiment of the external grille assembly.

FIG. 10 depicts a top cut view of an embodiment of the external grille assembly 60 with an external grille 50. A first tubular 24 of a connector 10 can be engaged within an exterior screw boss 64 of a door insert, such as with a connector hole. A fastener 72 can be threadably engaged with the first tubular 24 through the interior screw boss 68 and the exterior screw boss 64. The external grille assembly 60 can include a first translucent panel 76*a* and a second translucent panel 76*b*. The external grille assembly 60 can be connected to a door 51. The external grille 50 can be formed of one or more square tubulars, such as square tubular 57.

Figure 11:
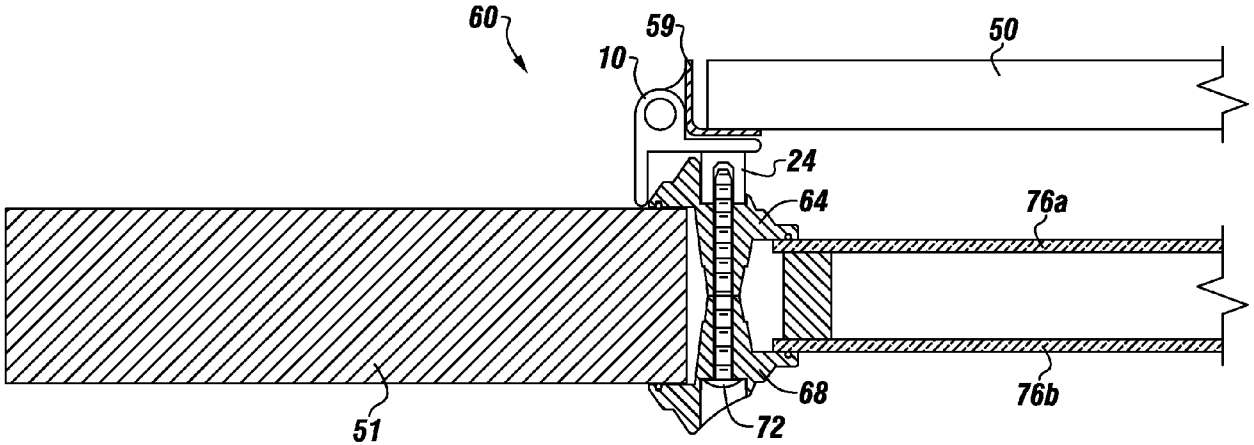
FIG. 11 depicts a top cut view of another embodiment of the external grille assembly.

FIG. 11 depicts a top cut view of an embodiment of the external grille assembly 60 with an external grille 50. A first tubular 24 of a connector 10 can be engaged within an exterior screw boss 64 of a door insert, such as with a connector hole. A fastener 72 can be threadably engaged with the first tubular 24 through the interior screw boss 68 and the exterior screw boss 64. The external grille assembly 60 can include a first translucent panel 76*a* and a second translucent panel 76*b*. The external grille assembly 60 can be connected to a door 51. The external grille 50 can be formed of one or more L-shaped tubulars, such as L-shaped tubular 59.

One or more embodiments relate a method for attaching an external grille.

Figure 12A:
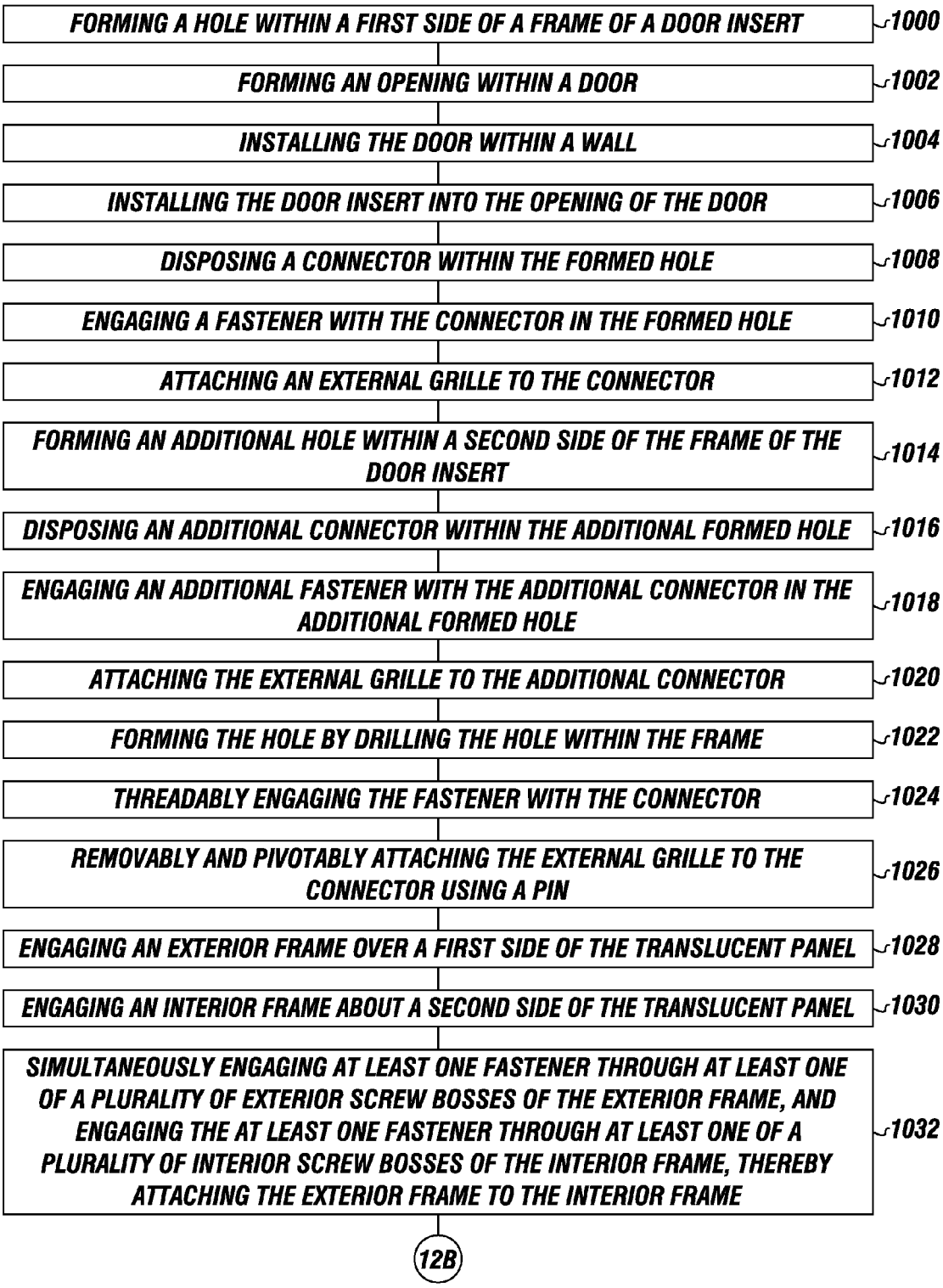
FIG. 12A depicts a flow chart of a method for attaching an external grille to a door.

FIG. 12A depicts an embodiment of a method for attaching an external grille to a door.

The method can include forming a hole within a first side of a frame of a door insert, as illustrated by box 1000.

The method can include forming an opening within a door, as illustrated by box 1002.

The method can include installing the door within a wall, as illustrated by box 1004.

The method can include installing the door insert into the opening of the door, as illustrated by box 1006.

The method can include disposing a connector within the formed hole, as illustrated by box 1008.

The method can include engaging a fastener with the connector in the formed hole, as illustrated by box 1010.

The method can include attaching an external grille to the connector, as illustrated by box 1012.

The method can include forming an additional hole within a second side of the frame of the door insert, as illustrated by box 1014.

The method can include disposing an additional connector within the additional formed hole, as illustrated by box 1016.

The method can include engaging an additional fastener with the additional connector in the additional formed hole, as illustrated by box 1018.

The method can include attaching the external grille to the additional connector, as illustrated by box 1020.

The method can include forming the hole by drilling the hole within the frame, as illustrated by box 1022.

The method can include threadably engaging the fastener with the connector, as illustrated by box 1024.

The method can include removably and pivotably attaching the external grille to the connector using a pin, as illustrated by box 1026.

The method can include engaging an exterior frame over a first side of the translucent panel, as illustrated by box 1028.

The method can include engaging an interior frame about a second side of the translucent panel, as illustrated by box 1030.

The method can include simultaneously engaging at least one fastener through at least one of a plurality of exterior screw bosses of the exterior frame, and engaging the at least one fastener through at least one of a plurality of interior screw bosses of the interior frame, thereby attaching the exterior frame to the interior frame, as illustrated by box 1032.

Figure 12B:
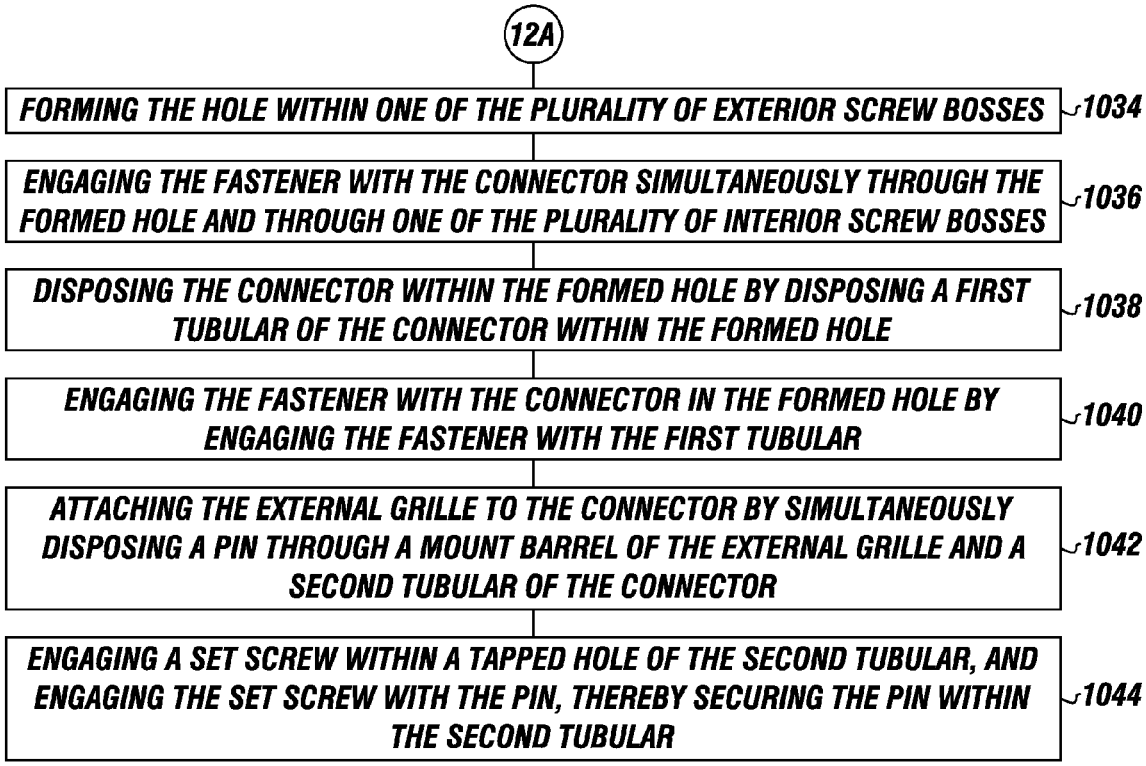
FIG. 12B is a continuation of FIG. 12A.

FIG. 12B is a continuation of FIG. 12A. The method can further include forming the hole within one of the plurality of exterior screw bosses, as illustrated by box 1034.

The method can include engaging the fastener with the connector simultaneously through the formed hole and through one of the plurality of interior screw bosses, as illustrated by box 1036.

The method can include disposing the connector within the formed hole by disposing a first tubular of the connector within the formed hole, as illustrated by box 1038.

The method can include engaging the fastener with the connector in the formed hole by engaging the fastener with the first tubular, as illustrated by box 1040.

The method can include attaching the external grille to the connector by simultaneously disposing a pin through a mount barrel of the external grille and a second tubular of the connector, as illustrated by box 1042.

The method can include engaging a set screw within a tapped hole of the second tubular, and engaging the set screw with the pin, thereby securing the pin within the second tubular, as illustrated by box 1044.

While these embodiments have been described with emphasis on the embodiments, it should be understood that within the scope of the appended claims, the embodiments might be practiced other than as specifically described herein.

What is claimed is:

1. An external grille assembly for a door, the external grille assembly comprising:

a. a door insert comprising:

(i) a translucent panel with a first side and a second side;

(ii) a frame engaged over the first side and the second side of the translucent panel; and (iii) a connector hole formed on a first side of the frame;

b. a connector engaged within the connector hole, the connector comprising:

(i) a first plate connected to a second plate at a right angle, wherein the first plate has a first side and a second side;

(ii) a first tubular extending from the first side of the first plate at a right angle, wherein the first tubular is disposed within the connector hole;

(iii) a fastener engaged with the first tubular within the connector hole, thereby attaching the connector to the door insert; and (iv) a second tubular disposed at an intersection of the first plate and the second plate and connected to the second side of the first plate;

c. an external grille comprising:

(i) a grille frame;

(ii) a grille design portion disposed within the grille frame; and (iii) a mount barrel formed on a first side of the grille frame;

d. a pin simultaneously engaged through the mount barrel and the second tubular, thereby mounting the external grille to the connector and to the door insert on the first side of the frame.

2. The external grille assembly of claim 1, wherein the frame further comprises:

a. an exterior frame disposed over the first side of the translucent panel;

b. an interior frame disposed over the second side of the translucent panel and attached to the exterior frame;

c. a plurality of exterior screw bosses disposed through the exterior frame;

d. a plurality of interior screw bosses disposed through the interior frame and axially aligned with the plurality of exterior screw bosses; and e. at least one fastener simultaneously disposed through at least one of the plurality of exterior screw bosses and at least one of the plurality of interior screw bosses, thereby fastening the exterior frame to the interior frame, wherein the connector hole is formed within one of the plurality of external screw bosses, and wherein the fastener engaged with the first tubular within the connector hole is also engaged through one of the plurality of interior screw bosses.

3. The external grille assembly of claim 1, wherein the external grille is pivotable about the pin.

4. The external grille assembly of claim 1, further comprising:

a. an additional connector hole formed on a second side of the frame;

b. an additional connector engaged within the additional connector hole, wherein the additional connector comprises:

(i) a first plate connected to a second plate at a right angle, wherein the first plate has a first side and a second side;

(ii) a first tubular extending from the first side of the first plate at a right angle, wherein the first tubular is disposed within the additional connector hole;

(iii) a fastener engaged with the first tubular within the additional connector hole, thereby attaching the additional connector to the door insert; and (iv) a second tubular disposed at an intersection of the first plate and the second plate and connected to the second side of the first plate;

c. an additional mount barrel formed on a second side of the grille frame; and d. an additional pin simultaneously engaged through the additional mount barrel and the second tubular of the additional connector, thereby mounting the external grille to the additional connector and to the door insert on the second side of the frame.

5. The external grille assembly of claim 4, wherein the pin is removable from the mount barrel and the second tubular of the connector allowing the external grille to be pivotable about the additional connector, and wherein the additional pin is removable from the additional mount barrel and the second tubular of the additional connector allowing the external grille to be pivotable about the connector.

6. The external grille assembly of claim 4, wherein the external grille is removable from the connector and the additional connector, allowing for attachment of an impact-resistant material to the connector, the additional connector and the door insert.

7. The external grille assembly of claim 1, wherein the translucent panel is a glass panel, a Plexiglas panel, an insulated glass panel, a transparent panel, a privacy window, or combinations thereof.

8. The external grille assembly of claim 1, wherein the grille frame comprises square tubulars, round tubulars, L-shaped angled bars, or combinations thereof.

9. The external grille assembly of claim 1, further comprising:

a. a tapped hole disposed through the second tubular; and b. a fastener disposed through the tapped hole and engaged with the pin inside the second tubular, thereby securing the pin within the second tubular.

10. The external grille assembly of claim 1, wherein:

a. the first plate further comprises a top edge, a first side edge, a second side edge and a bottom edge;

b. the first tubular is disposed centrally between the top edge and the bottom edge; and c. the first tubular is disposed closer to the second side edge than to the first side edge.

11. The external grille assembly of claim 1, wherein the fastener is threadably engaged with the first tubular.

12. A method for attaching an external grille to a door, the method comprising:

a. forming a hole within a first side of an exterior frame of a door insert, wherein the door insert further comprises an interior frame attached to the exterior frame and a translucent panel disposed between the exterior frame and the interior frame;

b. installing the door insert into a door;

c. disposing a connector within the formed hole;

d. engaging a fastener with the connector in the formed hole, thereby attaching the connector to the door insert; and e. attaching an external grille to the connector, thereby removably and pivotably mounting the external grille to the first side of the exterior frame of the door insert.

13. The method of claim 12, further comprising:

f. forming an additional hole within a second side of the exterior frame of the door insert;

g. disposing an additional connector within the additional formed hole;

h. engaging an additional fastener with the additional connector in the additional formed hole, thereby attaching the additional connector to the door insert; and i. attaching the external grille to the additional connector, thereby removably and pivotably mounting the external grille to the second side of the exterior frame of the door insert.

14. The method of claim 12, further comprising forming the hole by drilling the hole within the external frame.

15. The method of claim 12, further comprising threadably engaging the fastener with the connector.

16. The method of claim 12, further comprising removably and pivotably attaching the external grille to the connector using a pin.

17. The method of claim 12, wherein:

j. the exterior frame comprises a plurality of exterior screw bosses; and k. the interior frame comprises a plurality of interior screw bosses axially aligned with the plurality of exterior screw bosses, and wherein the method further comprises:

(i) engaging the exterior frame over a first side of the translucent panel;

(ii) engaging the interior frame about a second side of the translucent panel;

(iii) simultaneously engaging at least one fastener through at least one of the plurality of exterior screw bosses and at least one of the plurality of interior screw bosses;

(iv) forming the hole within one of the plurality of exterior screw bosses; and (v) engaging the fastener with the connector simultaneously through the formed hole and one of the plurality of interior screw bosses.

18. The method of claim 12, wherein the connector comprises:

a. a first plate connected to a second plate at a right angle, wherein the first plate has a first side and a second side;

b. a first tubular extending from the first side of the first plate at a right angle; and c. a second tubular disposed at an intersection of the first plate and the second plate and connected to the second side of the first plate, wherein the method further comprises:

(i) disposing the connector within the formed hole by disposing the first tubular within the formed hole;

(ii) engaging the fastener with the connector in the formed hole by engaging the fastener with the first tubular; and (iii) attaching the external grille to the connector by simultaneously disposing a pin through a mount barrel of the external grille and the second tubular of the connector.

19. The method of claim 18, wherein the second tubular comprises a tapped hole, and wherein the method further comprises: engaging a set screw within the tapped hole and engaging the set screw with the pin, thereby securing the pin within the second tubular.

* * * * *